United States Patent [19]

Van Mechelen

[11] Patent Number: 4,940,220

[45] Date of Patent: Jul. 10, 1990

[54] SUPPORTING DEVICE

[76] Inventor: Lambertus M. Van Mechelen, Kleine Singel 39, 3572 CG Utrecht, Netherlands

[21] Appl. No.: 317,620

[22] Filed: Mar. 1, 1989

[30] Foreign Application Priority Data

Mar. 4, 1988 [NL] Netherlands ..... 8800550

[51] Int. Cl.[5] ..... B41L 47/00

[52] U.S. Cl. ..... 271/2; 271/30.1; 271/147; 271/148; 271/171; 271/233; 271/234; 271/253

[58] Field of Search ..... 271/2, 30.1, 233, 234, 271/236, 253, 148, 171, 147, 144, 223, 224, 163; 414/795.8, 796.7, 788.9

[56] References Cited

U.S. PATENT DOCUMENTS

| | | | |
|---|---|---|---|
| 1,013,160 | 1/1912 | Hariel | 271/2 X |
| 1,395,897 | 11/1921 | Berkowitz | 271/171 |
| 1,863,465 | 6/1932 | Borrowdale | 271/213 X |
| 2,550,160 | 4/1951 | Monk | 271/171 |
| 2,994,529 | 8/1961 | Relis | 271/209 X |
| 3,022,997 | 2/1962 | Pendley | 271/148 |
| 3,052,467 | 9/1962 | Fertig | 271/217 X |
| 3,239,219 | 3/1966 | Reeves | 271/148 |
| 3,446,500 | 5/1969 | Meier | 271/148 |
| 3,567,216 | 3/1971 | Zeller | 271/148 |
| 3,897,052 | 7/1975 | Turman et al. | 271/188 |
| 4,022,459 | 5/1977 | Mather | 271/217 X |
| 4,188,026 | 2/1980 | Nagai | 271/148 |
| 4,529,190 | 7/1985 | Goodwin et al. | 271/189 X |
| 4,570,757 | 2/1986 | Marzullo | 271/171 |
| 4,625,641 | 12/1986 | Jagosz et al. | 271/2 X |
| 4,744,472 | 5/1988 | Pfister | 271/148 X |

*Primary Examiner*—Joseph J. Rolla
*Assistant Examiner*—Boris Milef
*Attorney, Agent, or Firm*—Webb, Burden, Ziesenheim & Webb

[57] ABSTRACT

A device (1) for supporting a stack of sheet material with zones of uneven thickness, e.g. envelopes (11), on a printer with a pick-up device (16, 17) for the envelopes and a table (10) is provided with a supporting plate (2) as well as bar type supporting apparatus (3,4) at the side facing away from the pick-up device (16, 17). The bar type supporting apparatus (3,4) may be swung away laterally for easy access to the envelopes. Furthermore the device (1) may be equipped with a base plate (36) having adjusting legs (37), for adjusting the device in a horizontal position on a slant table (10).

7 Claims, 6 Drawing Sheets

SUPPORTING DEVICE

The invention relates to a device for supporting a stack of sheet material on a feeder for a printer, where each sheet has zones of uneven thickness, such as envelopes, said feeder being provided with a table for the stack and a pick-up device above the table for essentially lateral removal of the top sheet of the stack each time.

In the case of envelopes in particular, the problem occurs that the stack slants more as its height increases. This is due to the uneven thickness of the envelopes, such as at the flap of the envelope or a window made therein. The top envelopes are consequently not horizontally supported, which means that, due to the short shocks to which the stack is exposed as a result of the action of the pick-up device, the envelopes slowly slip, or the whole stack even collapses. In practice, attempts have been made hitherto to deal with this problem by filling up the stack with wedges at the side where the envelopes are thinnest, so that the top envelopes will still end up lying flat. The problem cannot, however, be entirely solved by this method, since at certain points the envelopes are still supported in a non-horizontal plane, which again causes slipping to occur. Another attempt to solve this problem was made by making the table a tilting one, so that the bottom envelopes can be supported in such a slanting manner that the top envelopes lie more or less flat. Such a design is, however, extremely expensive.

According to the invention it is now possible to provide the table with a supporting plate which at the side facing away from the pick-up device is provided with one or more bar-type supporting means extending upwards along the stack. It is important that the envelopes in the pick-up device be fed to the printer with the flap facing forwards. This means that the thinnest side of each envelope faces the supporting means, with the result that the stack of envelopes has the tendency to lean over in that direction. The supporting means then form a good support for the stack.

The supporting device is particularly suitable for use for a feeder provided with a vertical feed wall having vertical feed edges which are at an adjustable distance from each other, and along which the table can move depending on the decrease in the stack. For this purpose, provision is made according to the invention for the supporting plate to have at its side facing away from the bar-type supporting means a lip which fits closely and slides between the feed edges. This design ensures that the stack of envelopes is stably supported over its entire surface on the supporting plate with supporting lip.

With this design the stack is confined between the feed wall of the feeder and the bar-type supporting means, so that it is no longer possible for the envelopes to slip or for the stack to collapse. The bar-type supporting means can be positioned in such a way on the supporting plate that they do not touch the pick-up device above the supporting plate. This is particularly important as the table - and thus the supporting plate with its bar-type supporting means - rises further up while the stack of envelopes is decreasing. The bar-type supporting means in this case can project an increasing distance through the suspension elements of the pickup device, which would be impossible if the supporting means consisted of a plate.

Another advantage of the supporting device is that, in order to obtain the desired holding action, the bar-type supporting means can be bent a little towards the feed wall. The slight clamping thus obtained has a beneficial effect on the stability of the stack.

The known feed edges can be set for different envelope formats by simply sliding them closer together or further apart. The supporting device according to the invention is in this respect also easy to adjust to different envelope formats, due to the fact that the lip is detachably connected to the plate. It can be, for example, a mortise and tenon joint. The supporting device can be adjusted easily if the lip which has the right dimensions for the format of the envelopes to be processed is always chosen.

According to a preferred embodiment, the bar-type supporting means are attached at their bottom end to the supporting plate in such a way that they can be turned in one and the same plane. This means that by swinging the supporting means apart there is sufficient space to place the stack of envelopes on the supporting plate. The supporting means can then be swung towards each other again, thereby giving the desired support of the stack.

The supporting plate is preferably provided with stops, in such a way that the bar-type supporting means in their end pivot position going towards each other run vertically. It is thus ensured in a simple manner that the supporting means in operation are always in the correct position, in such a way that when the table moves upwards they do not come into contact with the pick-up device.

Provision is also made according to the invention for the bar-type supporting means in the vertical position to be held by a friction device. For this, the supporting means do not need to be fixed or released by a separate operation.

According to the invention it is preferable to make provision above each pivot point in the plate for a recessed ball which is confined in a sleeve and pressed outwards by a spring, and which in its end position projects from the plate and can be pressed into the plate by swinging the appropriate bar-type supporting means into the vertical position.

For fastening of the supporting plate on the table, the supporting plate is provided according to the invention with a fastening strip, projecting at the side at which the bar-type supporting means are located, by means of which the supporting device can be fastened on the table.

As already mentioned above, a stack of sheets having areas of uneven thickness is filled up in such a way with a wedge that the top sheet lies more or less flat. A further improvement can be provided according to the invention in that provision is made on the supporting plate for a wedge for support of the stack, whose wedge edge runs at right angles to the pick-up device, and a wedge face of which mates with the supporting face through mutual guide means for sliding the wedge parallel to the pick-up device between a position in which it covers the surface of the supporting plate at the side of the supporting means facing the pick-up device and a position in which it is outside said surface.

This slidably mounted wedge has the advantage that it cannot vibrate out of the stack of sheets under the influence of the movements caused by the operation of the pick-up device. The desired compensation can be obtained with this wedge by setting its position on the supporting plate.

In some known printers the supporting table can be positioned permanently at an angle. The device according to the invention can also be used in this situation if the supporting plate is provided with a baseplate which has at least two adjustable supporting legs for placing the supporting plate in a horizontal position relative to the supporting table.

The device can therefore be used universally on a large number of different printers. The setting-up time needed for fitting and removing the device is short, and takes no more than thirty seconds. Thanks to this short setting-up time and the faultfree infeed by means of the device according to the invention, a considerable increase in the production speed of the printer can be ensured.

The invention will be explained below with reference to an example of an embodiment.

Figure 1:
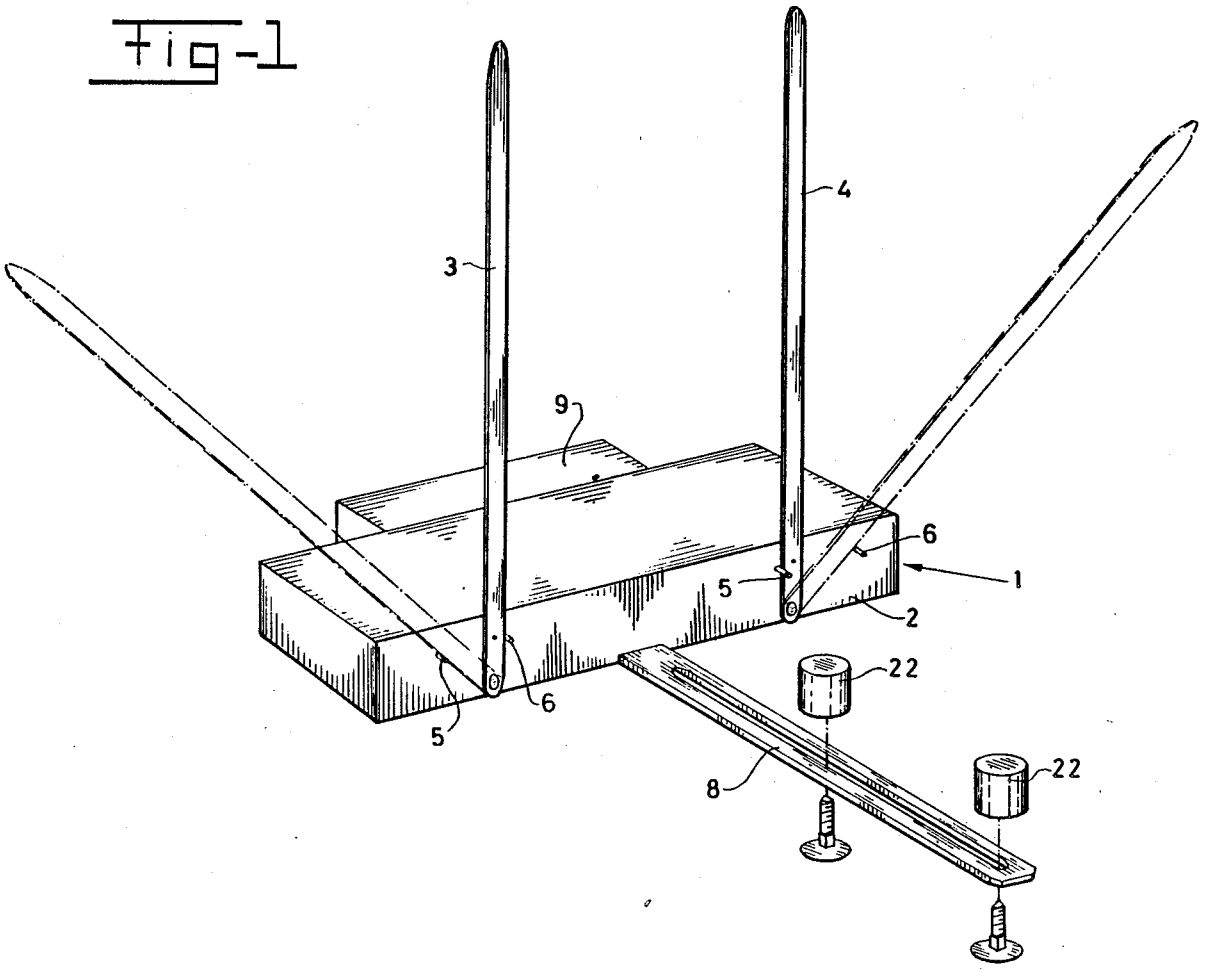
FIG. 1 shows the guide device according to the invention.

The guide device 1 in FIG. 1 comprises a supporting plate 2, on which two supporting bars 3, 4 are fitted so that they pivot. These bars 3, 4 can be swung between stop pins 5, 6. In the vertical position of the bars 3, 4 they are tensioned by a springloaded ball 7 which can be pressed into the supporting plate 2. This makes the bars 3, 4 stay in the vertical position.

In addition, a fixing rod 8 is connected to one side of block 2, while at the other side there is a lip 9, the functions of which will be explained with reference to FIGS. 2 and 3.

Figure 2:
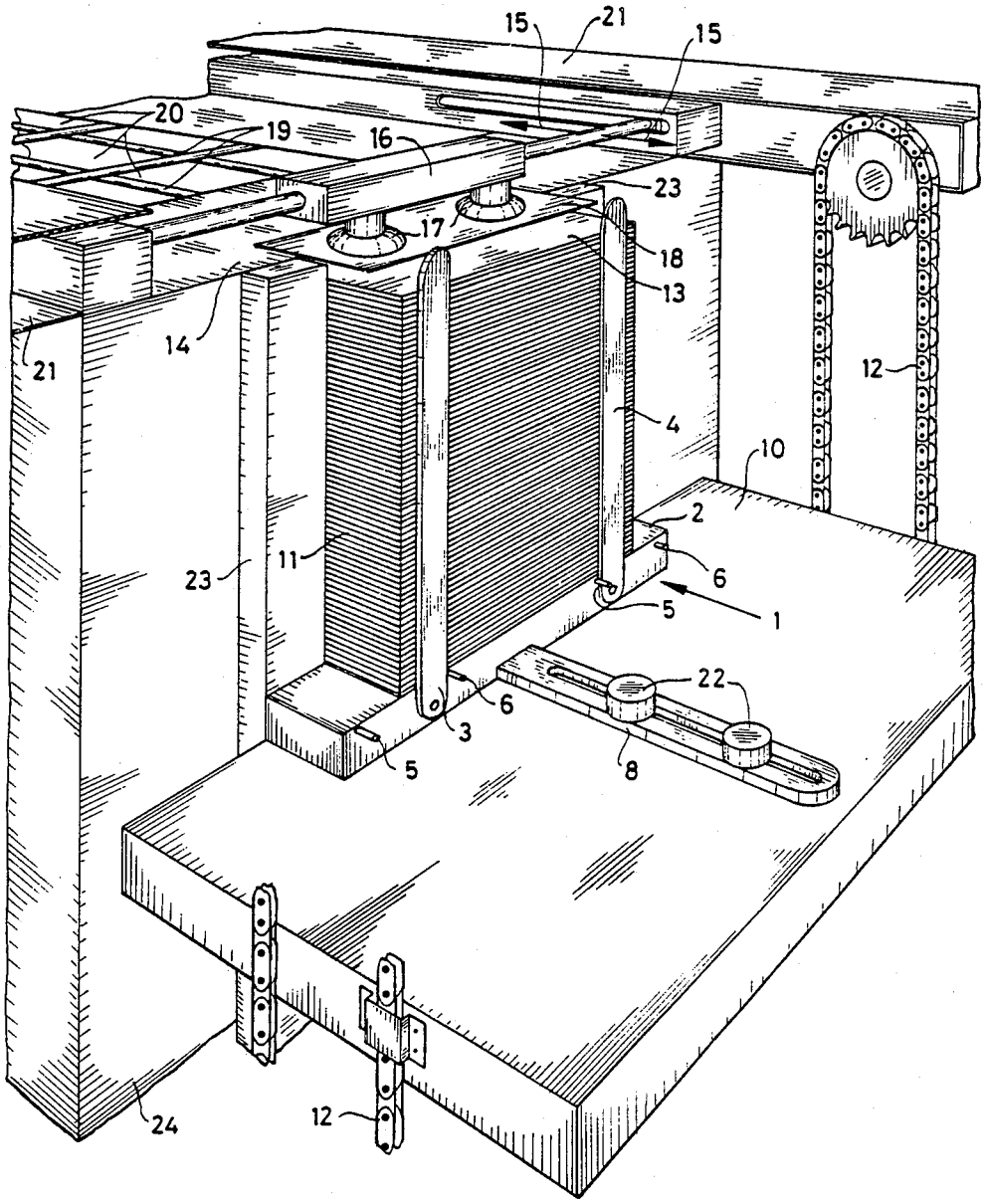
FIG. 2 shows this guide device fitted on the feeder of a printer.
Figures 3A, 3B, 3C, 3D, 3E, 3F:
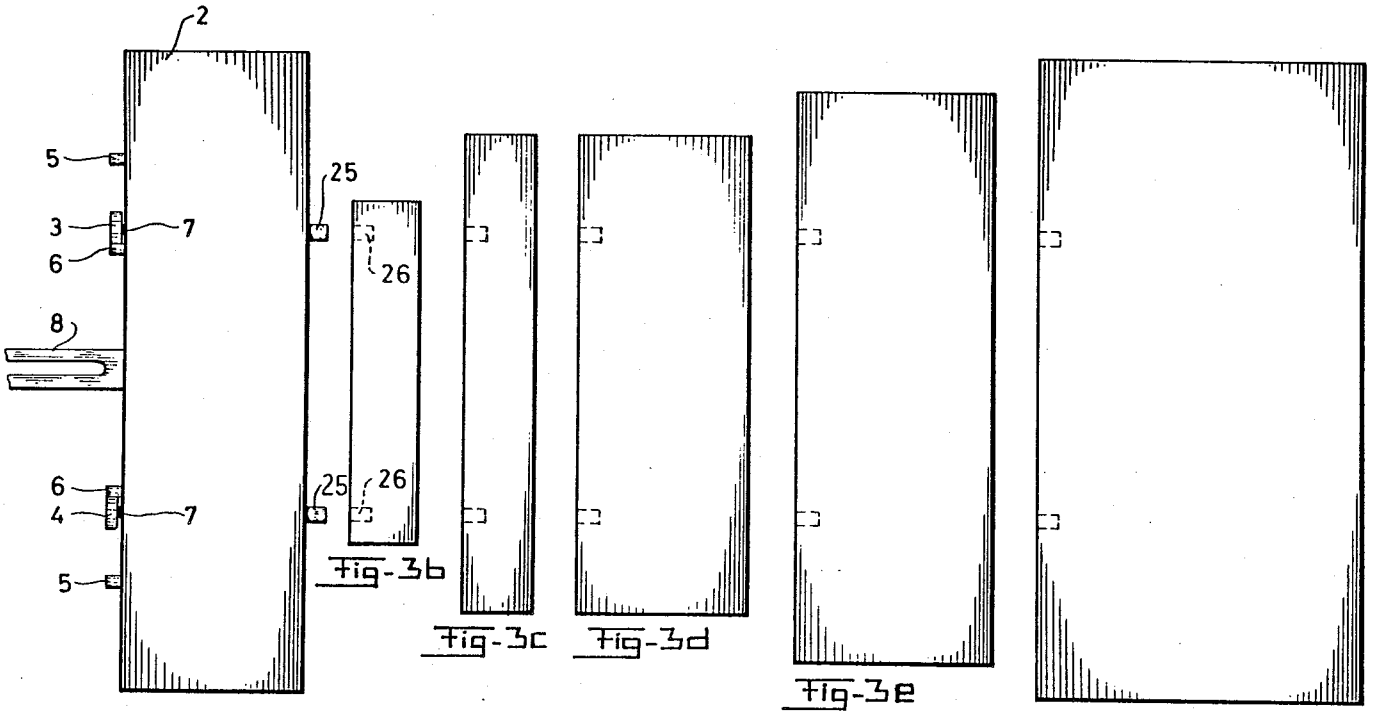
FIG. 3 shows a plan view of block 2 (FIG. 3*a*) and a series of possible embodiments of the lip (FIGS. 3*b*–3*f*) for the guide device.

In FIG. 2 a guide device 1 is provided on the table 10 of the feeder of a printer. For the infeed of the material to be printed, for example envelopes 11, the table 10 can be moved upwards along the feed edges 23 by means of chains 12 provided on either side. The height of the table 10 is constantly adjusted by means of a tracer (not shown), so that the top envelope 13 of the stack always lies approximately in the plane of the feed track 14. Envelope 18 has just been lifted by a to and fro moving carrier head 16, provided with suction cups 17. It is then moved to the feed track with the carrier head 16, where it is delivered to the conveyor device 19 which carries the envelopes 20 further.

The supporting and driving elements for carrier head 16 and chains 12 are located in the side structures 21. For the sake of clarity, the lefthand structure 21 and the lefthand chain 12 are only partially shown.

On such a known feed device the guide device 1 according to the invention is fixed to table 10 by means of fixing rod 8 and bolts 22. Lip 9 (not visible here) is selected in such a width that it fits precisely between the feed edges 23. The width of the lip 9 must correspond to the width of the envelopes 11 to be guided. The envelopes are now well supported at the side of the feed edges in a known manner against the feed wall 24 of the feed device. According to the invention, the envelopes 11 are now also well supported at the other side, since that is where the supporting bars 3, 4 are located. Since the distance between feed wall 24 and supporting bars 3, 4 depends on the size of the lip 9 it can always be ensured, by selecting a suitable lip 9, that this distance is equal to the size of the envelopes.

The envelopes can be placed easily on the guide device by pivoting the arms 3, 4, as shown in FIG. 1.

FIGS. 3*b* to 3*f* show possible embodiments of the lip.

At the lip side, block 2 is provided with pins 25 fitting into corresponding holes 26 of the lip. The breadth and the length of these lips can be selected in such a way that the guide device is always suitable for envelopes of a particular standard size. It goes without saying that the distance between the guide strips in FIG. 2 is set according to the length of the lip selected.

Figure 4:
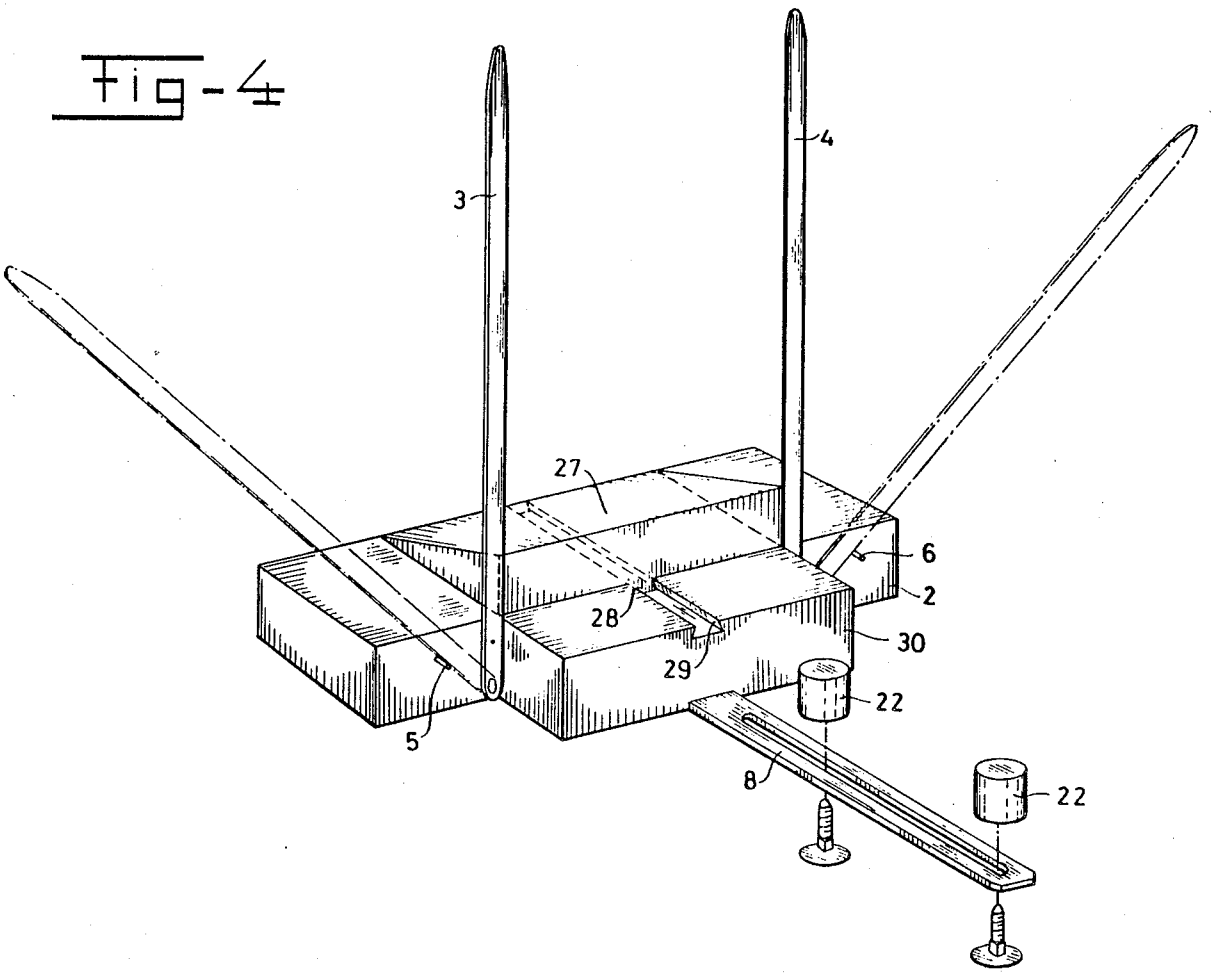
FIG. 4 shows the guide device with a wedge fitted on it.

FIG. 4 shows a guide device with a slidable wedge 27 fitted on the supporting plate 2, for example by a dovetail guide 28, 29. In order to be able to slide the wedge away fully from the surface of the supporting plate 2 on which the material to be printed is supported, this supporting plate 2 is provided with a projecting part 30 between the supporting bars 3, 4. Depending on the slant of the top sheet in the stack of sheets, the wedge 27 is pushed in a greater or lesser distance.

Figure 5:
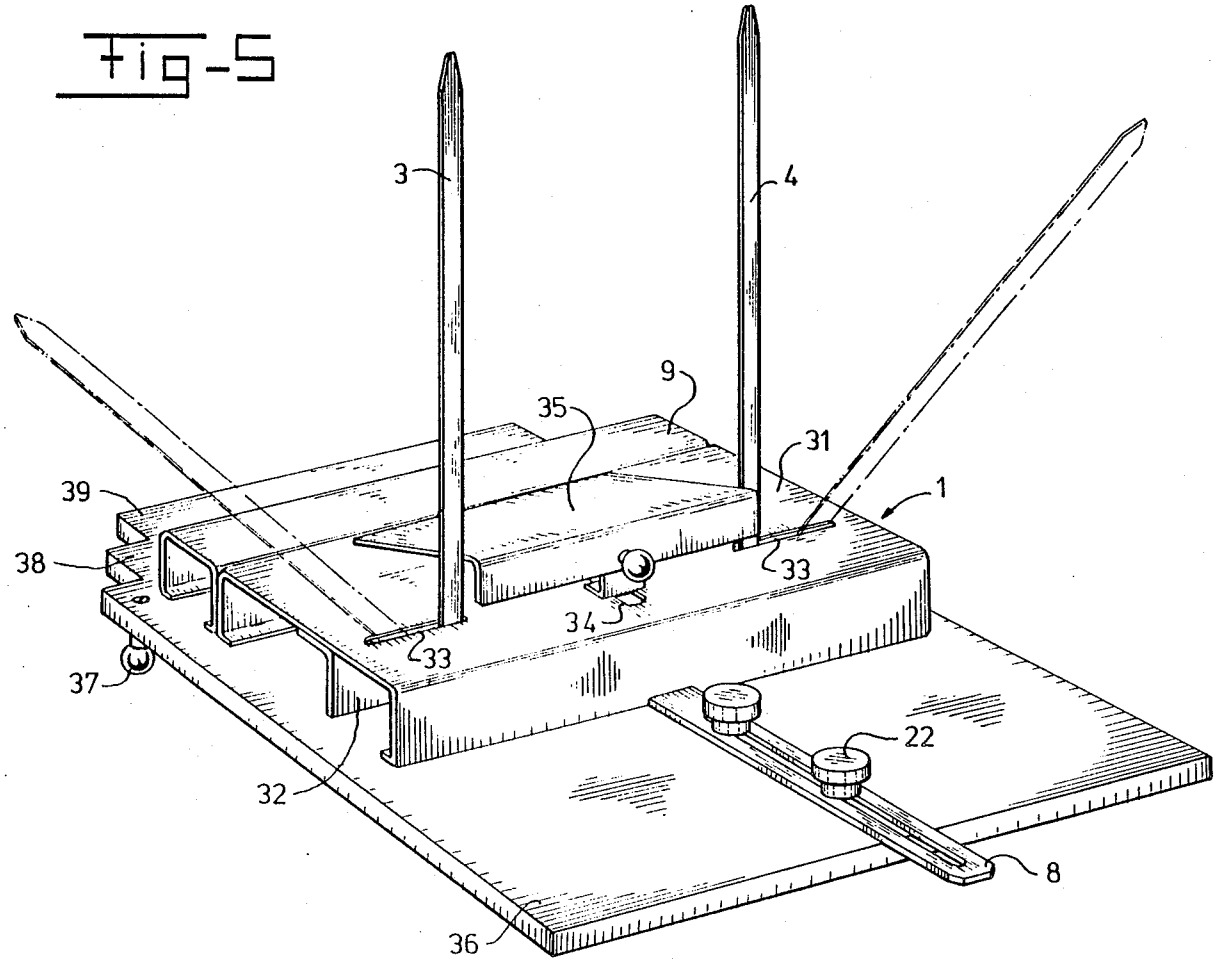
FIG. 5 shows a second embodiment.

The device shown in FIG. 5 has a supporting plate 31 made of sheet metal, and provided with supporting edges 32 to which supporting bars 3, 4 are fixed so that they pivot. These supporting edges are not present in the middle part of the supporting plate, in such a way that, by a suitable clamp means (not shown) the wedge 35 can be set at any position in the slot 34. The supporting bars 3, 4 run through the suppporting plate 31 via the slots 33. The supporting plate 31 is fixed on baseplate 36, which is provided with two adjusting legs 37 fitted in screw threaded holes. The baseplate 36, and thus the supporting plate 31, can be placed flat on a slanting supporting table by means of these adjusting legs.

Figure 6:
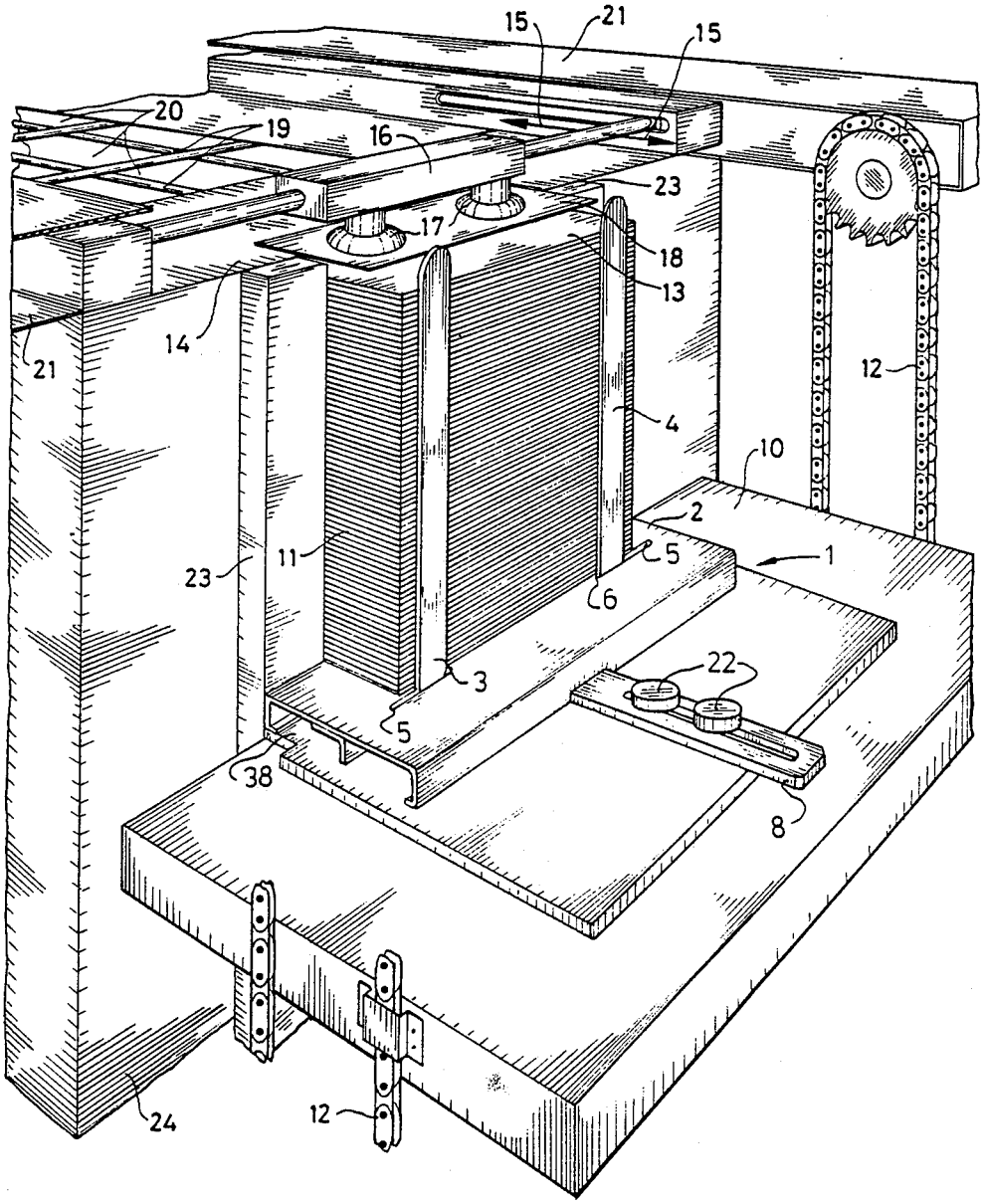
FIG. 6 shows the second embodiment fitted on the feeder of a printer.

At the side facing the feeder the supporting plate 36 is provided with areas 38, 39 having a stepwise reduced width. These areas can be fitted between the feed edges 23, together with a lip 9 of suitable width. In FIG. 6, area 39 is now situated between these feed edges 23, together with a lip 9 of the same width as area 39. In FIG. 6 the supporting table is horizontal so that there is no need for the adjusting legs 37 which are therefore left away. By means of bolts 22 the base plate is attached to the supporting table 10 and at the same time these bolts 10 are used for fixing the fixing rod 8.

I claim:

1. Device for supporting a stack of sheet material on a feeder for a printer, particularly where each sheet has zones of uneven thickness, such as envelopes, said feeder being provided with:

a supporting table for the stack;

two or more vertical feed walls having vertical feed edges which are at an adjustable distance from each other and along which the table can move depending on the decrease in the stack;

a pick-up device above the table for essentially lateral removal of the top sheet of the stack each time;

a supporting plate which can be fixed on the supporting table characterized in that at the side facing away from the vertical feed wall, the supporting plate is provided with one or more bar-type supporting means which freely extend upwards along the stack, and that at its side facing the vertical feed wall, the supporting plate has a lip which fits closely and slides between the feed edges.

2. Device according to claim 1, characterized in that the distance between the bar-type supporting means and the opposite feeder wall is smaller at the top of the supporting means than at the attachment point thereof.

3. Device according to claim 1, characterized in that the lip is detachably connected to the supporting plate.

4. Device according to claim 1, characterized in that the bar-type supporting means are attached at their bottom end to the supporting plate in such a way that they can be turned in one and the same plane.

5. Device according to claim 4, characterized in that the supporting plate is provided with stops in such a way that the bar-type supporting means in their end pivot position going towards each other run vertically.

6. Device according to claims 4 or 5, characterized in that provision is made on the supporting plate for a wedge for support of the stack whose wedge edge runs at right angles to the pick-up device, and a wedge face of which mates with the supporting face through mutual guide means for sliding the wedge parallel to the pick-up device between a position in which it covers the surface of the supporting plate at the side of the supporting means facing the pick-up device and a position in which it is outside said surface.

7. Device according to claim 4 or 5, characterized in that the supporting plate is provided with a baseplate which has at least two adjustable supporting legs for placing the supporting plate in a horizontal position relative to the supporting table.

* * * * *

UNITED STATES PATENT AND TRADEMARK OFFICE

CERTIFICATE OF CORRECTION

PATENT NO. : 4,940,220

DATED : July 10, 1990

INVENTOR(S) : Lambertus M. Van Mechelen

It is certified that error appears in the above-identified patent and that said Letters Patent is hereby corrected as shown below:

ON THE TITLE PAGE

Under [56] References Cited, after U.S. PATENT DOCUMENTS information insert --FOREIGN PATENT DOCUMENTS
8510062 3/1985 Germany
1205988 12/1965 Germany--.

Column 1 Line 66 "pickup" should read --pick-up--.

Column 3 Line 36 "springloaded" should read --spring-loaded--.

Signed and Sealed this

Fourth Day of February, 1992

*Attest:*

HARRY F. MANBECK, JR.

*Attesting Officer*

*Commissioner of Patents and Trademarks*